United States Patent [19]

Lemelson

[11] 4,204,398

[45] May 27, 1980

[54] METHOD AND MEANS FOR AUTOMATICALLY SETTING TIMEPIECES IN A TIME ZONE

[76] Inventor: Jerome H. Lemelson, 85 Rector St., Metuchen, N.J. 08840

[21] Appl. No.: 833,714

[22] Filed: Sep. 16, 1977

[51] Int. Cl.[2] ..... G04C 9/02; G04C 11/02

[52] U.S. Cl. ..... 36 58/47; 368/21; 368/51; 368/186

[58] Field of Search ..... 58/23 R, 24 R, 26 R, 58/34, 35 R, 35 W, 38 R, 42.5, 50 R, 57.5, 85.5

[56] References Cited

U.S. PATENT DOCUMENTS

| | | | |
|---|---|---|---|
| 4,020,628 | 5/1977 | Vittoz | 58/26 R X |
| 4,023,344 | 5/1977 | Mukaiyama | 58/35 W |
| 4,051,663 | 10/1977 | Chihara et al. | 58/26 R |
| 4,074,516 | 2/1978 | Kondo | 58/38 R |
| 4,147,022 | 4/1979 | Ichikawa | 58/35 W |

FOREIGN PATENT DOCUMENTS

| | | | |
|---|---|---|---|
| 517874 | 8/1976 | U.S.S.R. | 58/35 W |
| 515081 | 9/1976 | U.S.S.R. | 58/35 W |

*Primary Examiner*—S. J. Witkowski

*Attorney, Agent, or Firm*—Lerner, David, Littenberg & Samuel

[57] ABSTRACT

A timepiece is set by transmission of a time related signal which is received by the timepiece and converted into digital form. The circuit developing signals representing the time displayed by the timepiece is stepped more rapidly than normal and simultaneously compared with the time related signal until they compare at which time the rapid stepping of the timepiece is abruptly terminated and normal stepping of the timepiece is resumed. The carrier may be any supersonic frequency. Setting of the timepiece may be enabled only after operating a time check switch.

The above technique may be employed to produce an alarm at a requested time to serve as a memory or wake-up aid, for example.

25 Claims, 10 Drawing Figures

METHOD AND MEANS FOR AUTOMATICALLY SETTING TIMEPIECES IN A TIME ZONE

BACKGROUND OF THE INVENTION

International and even national travellers frequently cross from one time zone into another as a routine part of their travel. It thus becomes important for a person to remember to change a watch setting to conform to the new zone.

BRIEF DESCRIPTION OF THE INVENTION

The present invention is characterized by comprising a transmitting device and a timepiece adapted to receive a time change (or time check) signal developed by the transmitter and, upon demand, which is typically initiated by operation of a switch, to compare the received signal with the time signals constantly developed by the timepiece with the local standard. During the comparison operation, the timepiece is also caused to rapidly step the time signal generation means more rapidly than usual to more rapidly effect the comparison.

Alarm means may be provided to indicate the need for a time change to the wearer or to serve as a warning or wakeup or other reminder to the timepiece holder.

BRIEF DESCRIPTION OF THE FIGURES AND OBJECTS OF THE INVENTION

It is therefore one object of the present invention to provide a novel method and apparatus for automatically causing a change in the time displayed by a timepiece to bring the time of the timepiece into conformity with the local time zone.

Still another object of the invention is to bring the time displayed by a timepiece into conformity with the time zone in which the timepiece is located by receiving a time zone standard signal, rapidly changing the time stepping rate of the timepiece, comparing the time displayed by the timepiece against the time zone signal and returning the timepiece to its normal time stepping rate when the signals compare.

Still another object of the invention is to provide a timepiece with means for informing the holder of the timepiece of a need for a time change without automatically performing the time change.

Another object of the present invention is to provide for the development of an alarm to indicate the need for a time zone change or as a wake-up or memory aid.

The above, as well as other objects of the invention will become apparent when reading the accompanying description and drawings, in which.

FIGS. 3 and 5 through 8 and 9*a* show block diagrams of other embodiments of the invention.

Figure 9:
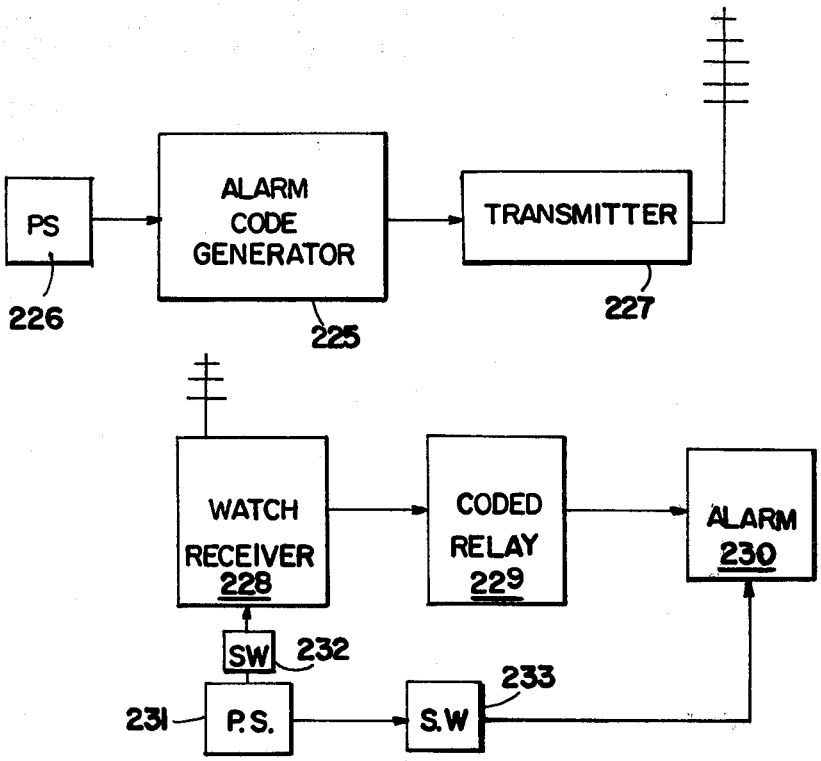
Figure 9A:
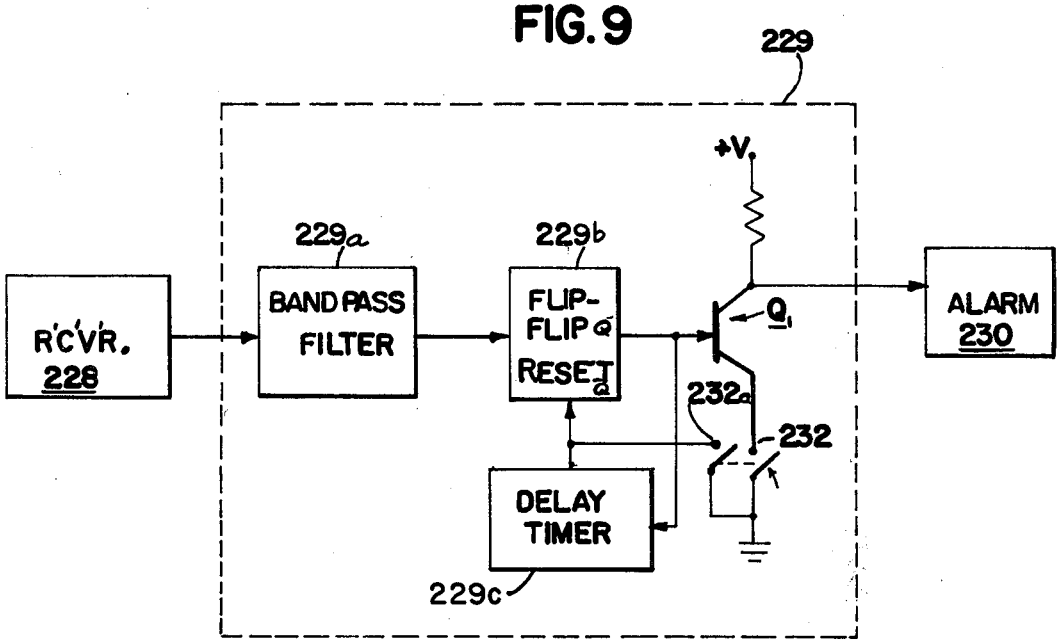

FIG. 9 shows a circuit arrangement which provides a timepiece with an alarm capability.

DETAILED DESCRIPTION OF THE INVENTION

Figure 1:
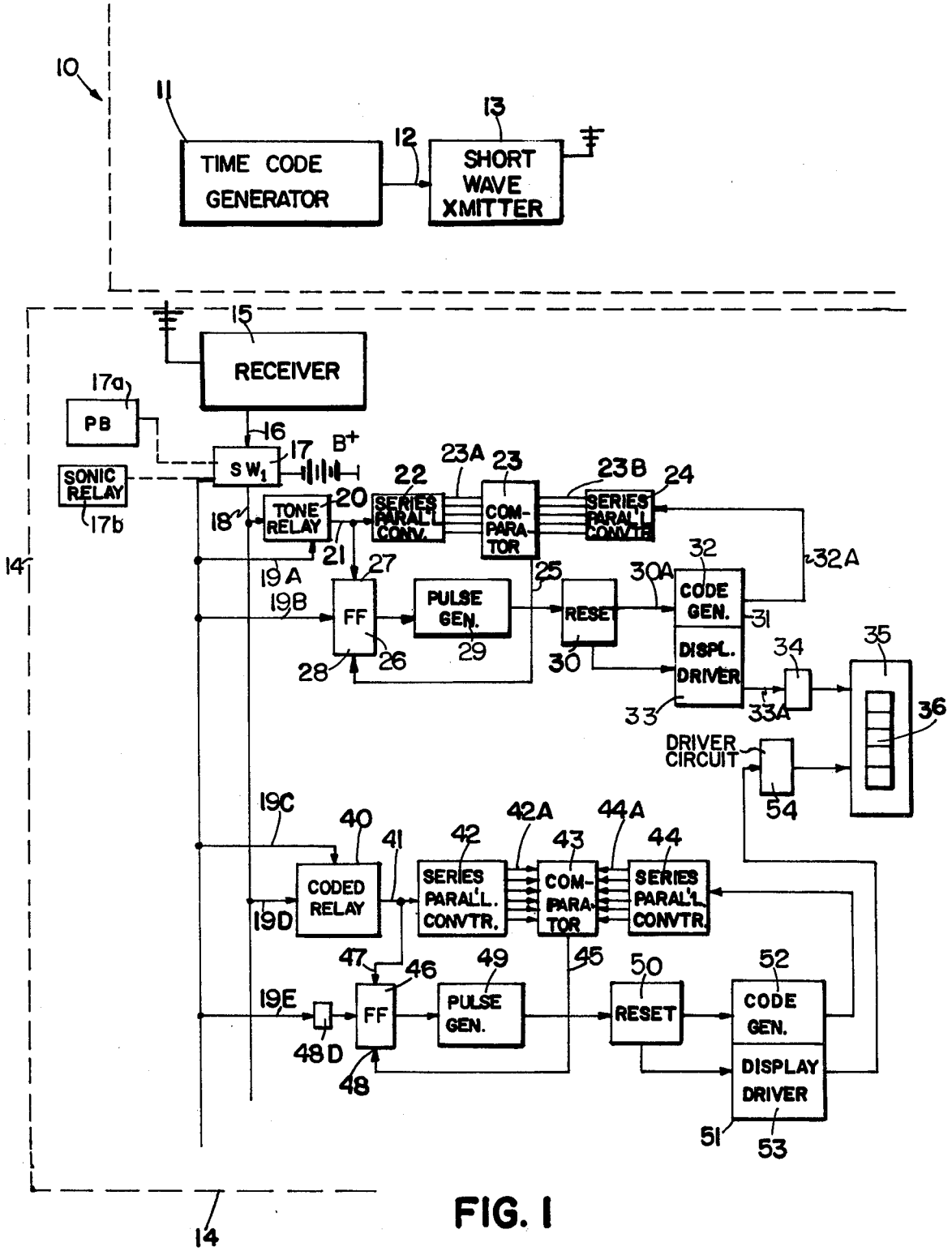
FIG. 1 is a block diagram of a timepiece adjustment system embodying the principles of the present invention.

FIG. 1 shows a system 10 for automatically setting or correcting electronic timepieces in accordance with the time zone in which the timepiece is located. The system 10 includes a time code generator 11 which includes clock means for generating sequential codes representative of time, such as the hours of the day and, in certain instances, minutes of each hour in a particular time zone. Generator 11 may also be located in a vehicle such as an aircraft, boat or train traveling from time zone to time zone and may include means for generating code signals which correctly indicate the local time as the vehicle passes from one time zone to another by means which will be described.

The output 12 of generator 11 is connected to a short wave transmitter 13 for transmitting radio waves or ultrasonic waves modulated with the coded time signals generated by output 11. A clock or watch, shown generally as numeral 14, contains a microminiature electronic circuit including a short wave radio or ultrasonic receiver 15, having an output 16 which is connected through a manually operated or signal responsive switch 17, operated by push button 17*a* or sonic relay 17*b*, for example, to a line 18 which is connected directly or through OR circuits to circuitry for correcting the time computing and driving circuits of the watch in accordance with the signals generated by time code generator 11 and intercepted by receiver 15. Switches 17 and 26 serve to locally actuate the time zone resetting circuitry by coupling circuit 15 to receiver circuit 17 and coupling battery B+ to 17.

The electronic watch 14 contains hour time generating and display driving circuitry which may be electrically corrected or changed by pulses applied thereto to cause the display driving circuits 33 thereof to activate the hour display units 36 of the time display 35 to display the correct hour of the day for the particular time zone in which the time piece is located. This correction may be obtained by means of electrical tone or code signals generated on the output 16 of receiver 15 and passed to a first code or tone responsive relay 20 which generates a signal at its output 21.

The output 21 of code (or tone) responsive relay 20 is connected to a serial-to-parallel converter 22 and a trigger switching input 27 of a bi-stable flip-flop switch 26 which changes state when code responsive relay 20 generates an output and passes energizing electrical energy from battery B+ to energize a pulse generator 29 which generates a train of pulses and applies these pulses to the hour reset circuitry 30 for the timepiece 14. An output 30A of reset circuit 30 is applied to energize an electronic circuit 32 which generates coded signals in a serial fashion, said codes being representative of the time in hours indicated by the output of an hour of day computer and display driver 33 having an output 32A on which is generated series codes indicative of the hour displayed and such series code signals are applied to a series-to-parallel converter 24, the outputs of which are connected to respective inputs 23B of a code matching relay 23 having its other set of parallel code inputs 23A connected to the outputs of series-to-parallel converter 22. The device 23 preferably includes a comparator circuit, comprised of exclusive-OR gates, coupled to an AND gate.

When the parallel code applied to inputs 23B of the code matching relay 23 compare with or is otherwise equivalent to the parallel code of circuit 22 applied to inputs 23A and which represents the correct time for that particular zone, a signal is generated by the AND gates (not shown) of the comparator and appears at output 25 which is applied to a reset input 28 of flip-flop switch 26 causing the flip-flop to reset and de-energize pulse generator 29 so that it ceases to develop pulses at its output, thereby retaining the hour indicating computing circuit 33 in a condition whereby its output 33A, when connected to the hour indicating display 35, will drive said display through driver circuits 34 to indicate the correct hourly time which has now been reset to the time zone in which the timepiece is located by application of the correct number of pulses developed by the pulse generator 29 before its de-energization, as described.

The minute display may be reset in the same fashion wherein coded relay 40 sets the signal representing the minutes reading to be displayed into encoder 42 to create a binary output code at 42A for connection with one set of inputs of comparator 43. The pulse generator is energized by the setting of flip-flop 46 under control of relay 40, causing minutes reset circuit 50 to generate pulses representative of the minutes setting in the local time zone. These signals are converted into parallel form by converter 44 for application to comparator 43.

The output of circuit 53 applies signals through driver circuitry 54 to the minutes display positions of display 36.

Figure 2:
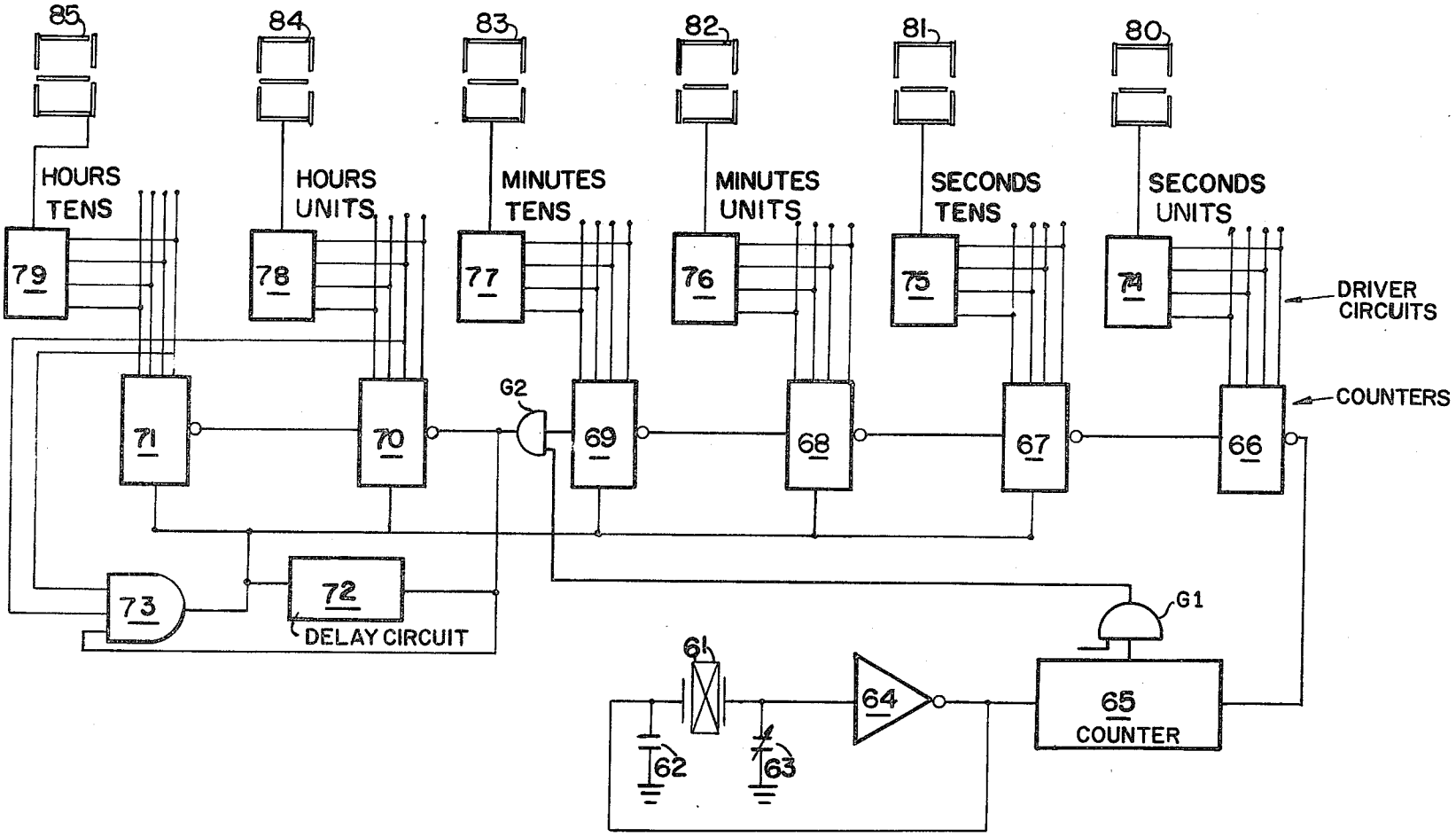
FIGS. 2 and 4 are block diagrams showing the electronics of timepieces adapted to incorporate the adjustment circuitry of the present invention.

Delay line 48D is provided to delay the signal employed to activate pulse generator 49 and being passed to flip-flop switch 46 until switch 46 has been closed by the signal transmitted on the output 41 of coded relay 40. FIG. 2 illustrates a scheme which may be employed in the timepiece of FIG. 1 whereby a stable oscillator frequency output is converted into binary coded decimal outputs, corresponding to timekeeping or accumulation of time, for application to an external device requiring such a code.

Crystal 61, fixed capacitor 62, trimmer capacitor 63, and amplifier 64 form a crystal oscillator circuit whose basic frequency is determined by crystal 61 and, over a limited range, capacitor 63.

Divider circuit 65 reduces the oscillator frequency to a pulse rate appropriate for the operation of B.C.D. (binary coded decimal) divider chain 66,67,68,69,70 and 71, which rate is typically one cycle per second.

Divider circuit 66 provides the units of seconds function and its B.C.D. output may be applied, as shown, to decoder driver circuit 74 for subsequent application to visual display unit 80. The operation and circuitry is basically the same for the remainder of the divider chain circuits 67–71, inclusive, according to the following arrangement:

Circuit 67—is the tens of seconds counter. 75 and 81 comprise the tens of seconds display means.

Circuit 68—is the units of minutes counter. 76 and 82 comprise its display means.

Circuit 69—is the tens of minutes counter. 77 and 83 comprise its display means.

Circuit 70—is the units of hours counter. 78 and 84 comprise its display means.

Circuit 71—is the tens of hours counter. 79 and 85 comprise its display means.

With regard to circuits 67 and 69, only 3 bits of B.C.D. information ($2^0$, $2^1$, $2^2$) are required as circuits 67 and 69 need only be provided with a count to 6 capability for timekeeping functions. For clock type operation, circuit 70 need only count to decimal 2, for 12 hour operation, or decimal 4 for 24 hour operation, and therefore need only have 2 binary bits ($2^0$, $2^1$) of information or 3 bits ($2^0$, $2^1$, $2^2$) of information, respectively, for its output. Circuit 79 need only output a decimal 1 bit ($2^0$) or 2 decimal bits ($2^0$, $2^1$) of information for 12 or 24 hour operation, respectively.

AND gate 73 and time delay means 72 comprise a circuit which resets all counters, with the exception of the units of seconds counter, at a count of 12:59:59 plus 1 count and, at the end of the reset cycle, enter a 1 in the units of hours counter, for 12 hour clock operation. For a 24 hour display capability, AND gate 73 need only be coupled the units of hours clock input, bit $2^0$, bit $2^1$, and tens of hours bit $2^1$. Delay means 72 is not necessary in this mode as it is not necessary to preload any counters after being reset.

The circuits 72 and 73 may be omitted completely if only accumulated timekeeping is required and the tens of hours bits $2^3$ and $2^2$, ones of hours bit $2^3$, tens of minutes bit $2^3$, and tens of seconds bit $2^3$ now become significant. This would be desirable if the circuit in FIG. 1 were, for example, used as a stop watch or running time indicator.

Figure 3:
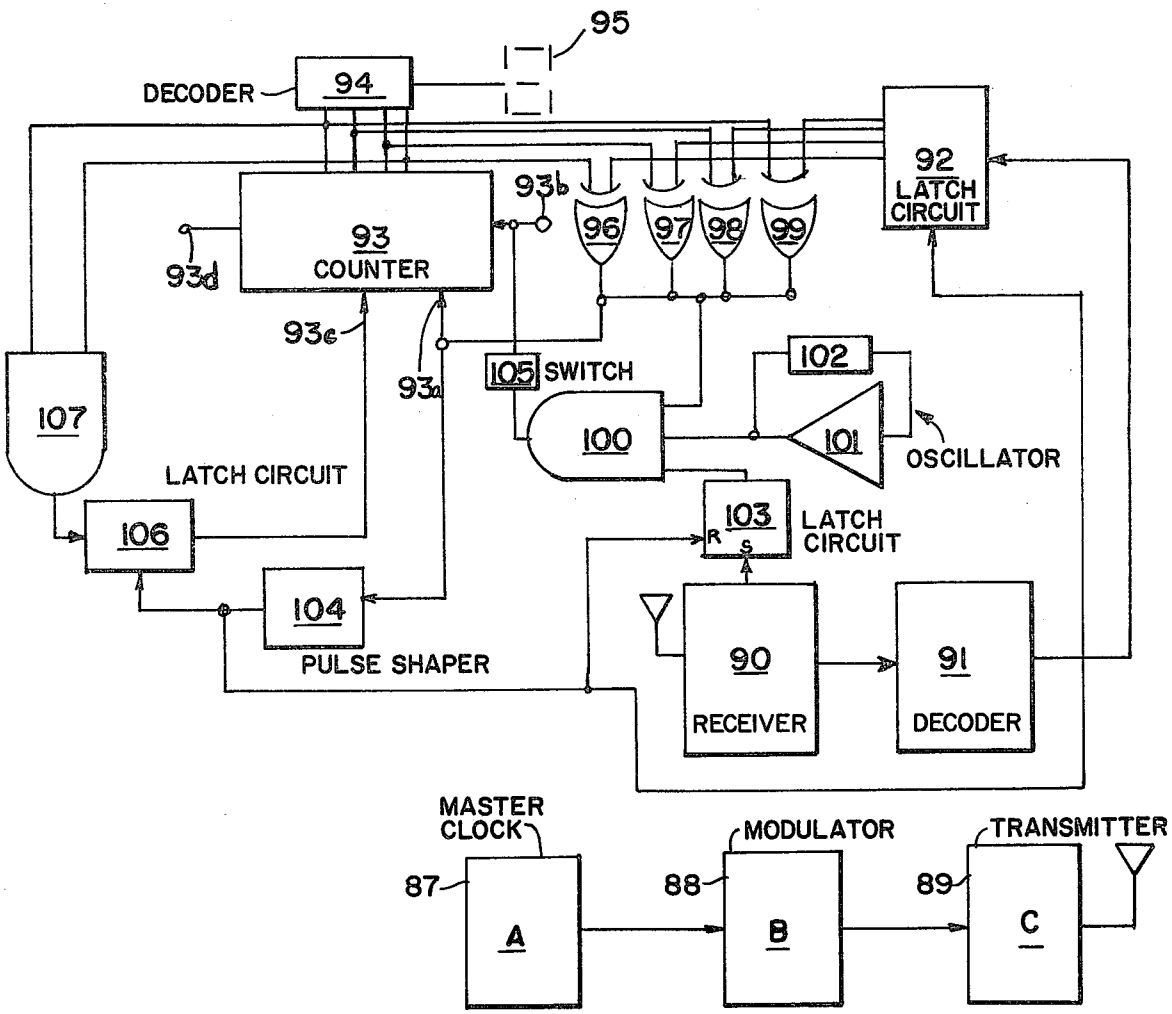

The circuit in FIG. 3 illustrates a possible means by which a counter, which may be one of a bank of counters, such as are employed in a timekeeping circuit for use in FIG. 1, may be brought into identity with a transmitted master time signal.

Coded time signals, incoming at receiver 90 originate from master clock and transmitter system comprising a master clock 87 and means 88 for modulating the carrier of a transmitter 89. The aforesaid signals are applied to decoder 91, which converts the received signals to a usable time code formal and applies the information in the converted form to latch circuit 92, which stores the time code until counter 93 is reset. Counter 93 develops an output which is coded, and may, for example, be in binary coded decimal format. The output may also be applied to decoder circuit 94 for subsequent application to the driver circuit (not shown) of a digital display means 95 to visually display the present count in counter 93. The counter 93 output is also applied to one or a multiplicity of OR gates, represented at 96, 97, 98 and 99, the other input of each gate being connected the output terminals of time latch circuit 92. If the binary levels of any of the time code lines from counter 93 are found to be out of identity with the codes available from latch 92, one of the outputs of 96, 97, 98 or 99 will change state to apply an input to AND gate 100 for, resetting counter 93 to zero via reset input **93*a*. The second input to AND gate 100 is derived from oscillator 101, whose feedback means is represented by 102, which oscillator may already exist elsewhere in the timekeeping circuit, or which may be a part of this circuit. The final input to AND gate 100 is an indication from receiver 90 that a signal, of sufficient strength to decode reliably, has been received. This signal is applied to set latch circuit 103 and is applied to the associated input of AND gate 100 to enable gate 100 until OR gates 96–99, inclusive, indicate that all time code lines are in identity, causing latch 103 to reset via pulse shaping circuit 104. When all of the inputs of AND gate 100 are true, the output developed by gate 100 enables the oscillator signal from oscillator 101 to be passed to manual disable switch 105, which is activated when the user does not wish the timekeeping device to be automatically reset, to apply pulses to counter clock input 93*b*, thus applying high speed clock pulses to advance counter 93 at a rate which is much faster than the normal rate. This continues until identity exists between the output of counter 93 and latch 92 at which time OR gates 96–99, inclusive, no longer provide a true input to AND circuit 100 thereby abruptly halting the passage of clock pulses through gate 100. The OR gate identity signal also resets latch 103, latch 106, and all the time code latches 92 via pulse shaper circuit 104**.

AND gate 107 and flip-flop 106 are provided to show how an up/down counter may be used at 93. The operations are identical to those described above except that AND gate 107 senses when the counter has reached a count of 9, to set latch 106 and cause count down input **93*c* of counter 93 to be activated. Counter 93 will now count down until time identity is achieved at which time it is reset by the comparator as previously stated. The counter now responds to pulses at its normal clock input 93*b* for continuation of the timekeeping function. The above function might be found desirable if only one digit is to be reset and it is necessary to prevent erroneous carry output signals from counter output 93*d* to create errors in the count of subsequent devices connected to counter 93. This may also be accomplished by automatically disconnecting the counter carry output at 93*d*** for the duration of time identity setting function.

Figure 4:
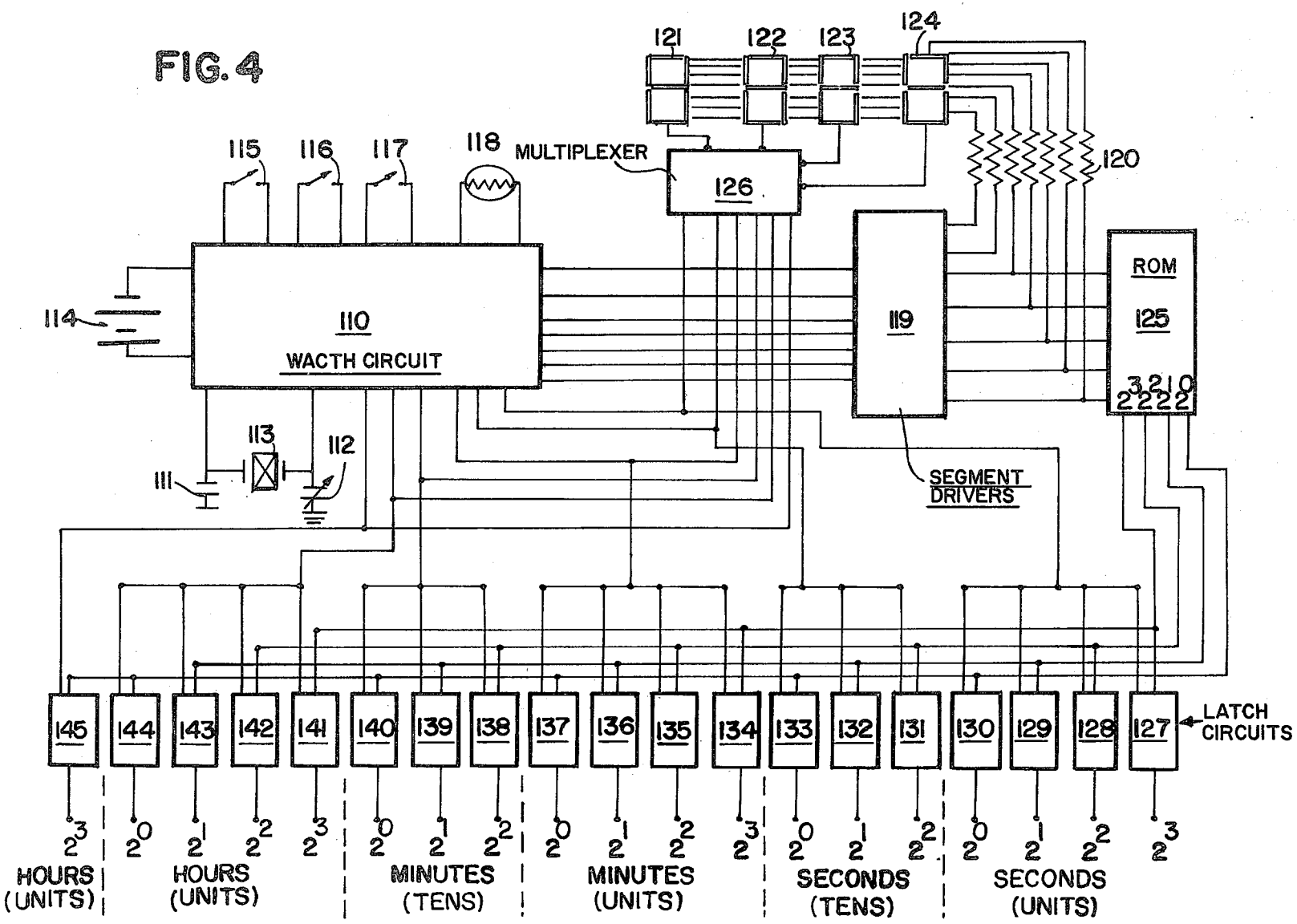

FIG. 4 presents a format by which any multiplexed 7-segment (L.E.D. compatible) signal, in this example a watch circuit, may be demultiplexed into a binary coded decimal format.

Watch circuit 110, which is crystal controlled by an oscillator circuit comprised of capacitors 111 and 112 and crystal 113, is energized by battery 114, and may have options such as time and set functions 115, 116, 117, automatic brightness control sensor unit 118 etc., develops a 7-segment signal by 4-digit multiplexed signals for application to segment drivers 119 and digit drivers at 120 which may be an integral part of watch circuit 110. These signals are then applied to a display means (such as an L.E.D. display) for visual presentation of the time by the 7-segment display devices 121–124. The segment signals are applied via current limiting resistors, to protect the display.

The segment signals are also applied to programmable read-only memory (ROM) 125 for decoding to a 4-bit B.C.D. format. It is not necessary to use all of the 7-segment signals to reliably distinguish between the digits 0–9. One of several possible segment choices might be the A, B, E, F, and G segments. This choice will provide an unambiguous code and minimize the memory space needed in memory.

If desired, the B.C.D. format may be developed in serial fashion at the output of ROM 125 marked bits $2^0$, $2^1$, $2^2$, $2^3$ and clocked at the number of digits times the mux rate of the watch chip 110.

Latch circuits 127–145, inclusive, provide sample and hold functions for the B.C.D. information produced at the output of ROM 125 and allow that information to be presented at all outputs at all times. The latch circuits 127–145, inclusive, have their respective inputs coupled to bit $2^0$ or $2^1$ or $2^2$ or $2^3$ outputs of ROM 125 and are selectively enabled by signals derived from the digit drive signal of circuit 110, such that the information gathered and presented will represent the proper digit, be it hours, minutes or seconds.

The arrangement of circuits 127–145 in FIG. 4 and the separation into hours, minutes and seconds divisions are exemplary of the use of these circuits as a clock circuit decoder, but the basic principle may be applied to any multiplexed output which is desired to be converted to a B.C.D. format.

AUTOMATIC TIME ACCURACY AND TIME ZONE CORRECTIONS FOR ELECTRONIC CLOCKS AND WATCHES

An alternative embodiment will now be described of a system which is capable of automatically resetting an electronic watch or clock by one (or several) master clock(s) which transmit(s) coded time signals corrected for time accuracy and/or a time zone change.

Figure 5:
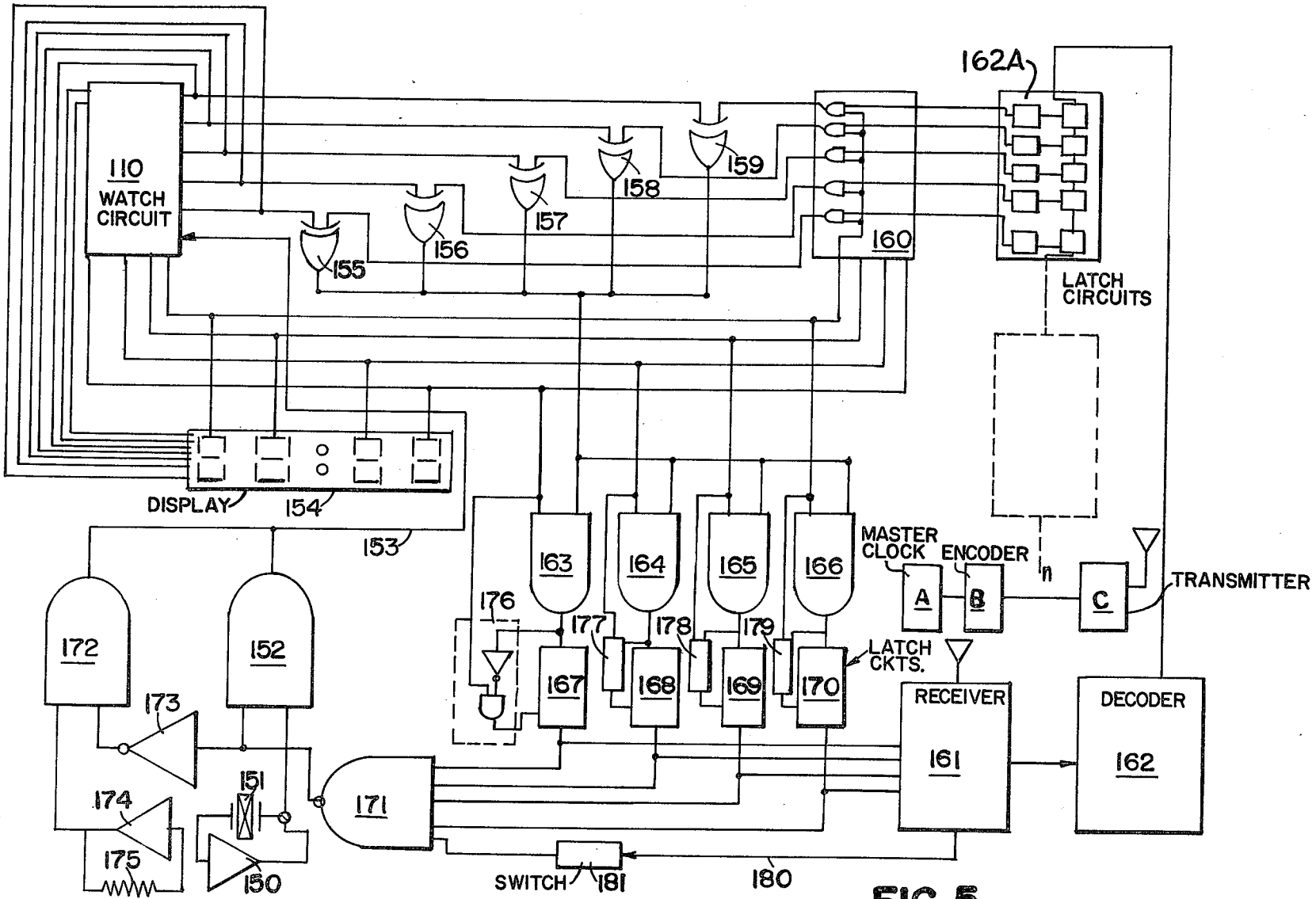
Figure 6:
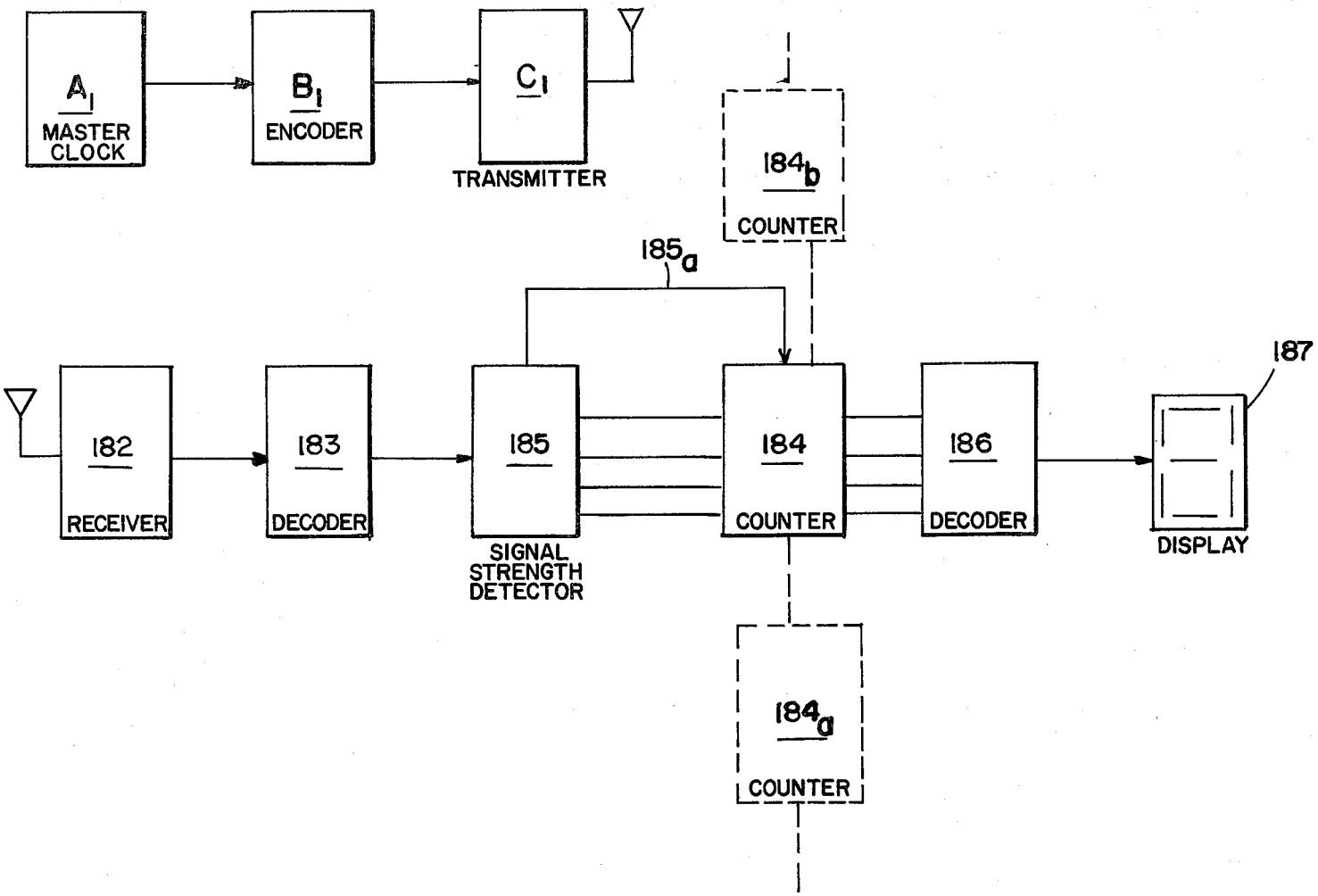

With regard to FIGS. 5 and 6, the time signal originating means is represented by a master clock $A_1$ which is characterized by a high degree of accuracy and which may be derived from presently maintained standard Time Broadcasts or other sources. A time coding means $B_1$ which processes master clock time signals of master clock $A_1$ and conditions them for subsequent application to transmitting means $C_1$, to be transmitted to a receiver incorporated in a timepiece for the purpose of automatic time correction.

FIGS. 5 and 6 and their accompanying explanatory comments show different means by which automatic time correction may be achieved.

AUTOMATIC TIME CORRECTION USING PRE-EXISTING WATCH CIRCUITRY OR WHERE ONLY MULTIPLEXED SIGNALS ARE AVAILABLE

The following system, through a simple modification, enables a timekeeping device, which may have as it outputs only a multiplexed signal, and as its only input an oscillator signal, employed to perform a time zone correction. The signal generated by oscillator 150 has a feedback circuit 151 which is preferably a crystal, coupled via AND circuit 152 and oscillating input correcting means 153, has an output multiplexed signal representing the time and which may be applied to visual display means 154. OR circuits 155–159 compare the codes for time output from watch circuit 110 (see FIG. 4) with those present at multiplexing AND gate matrix 160 and develop a change of output state if these codes (they may be B.C.D. or 7-segment or some other code format) are not identical.

Receiver circuit 161 derives its input signal via master clock 1 encoder and time transmitting means $A_1$, $B_1$ and $C_1$ and demodulates it for application to decoder circuit 162 which decodes the master time signals for application to time holding latch circuits 162A and for subsequent application to input multiplexing AND gates 160. The other inputs to gates 160 are derived from the multiplex generator of watch circuit 110, in this case, and as one example, the digit drive signals of watch circuit 110. Gates 160 apply the proper digit information to OR gates 155–159 inclusive to coincide with the same digit information from watch circuit 110.

If identity is not present on any one or more of the coded time lines of circuits 110 and 160, one or more of OR gates 155–159 change their output state to activate an input of AND gates 163–166. The remaining inputs of gates 163–166 are derived from, in this example, the digit drive signals of watch circuit 110. When any one of gates 155–159 respond to a lack of comparison, one of the AND circuits 163–166 changes output state to set a corresponding latch circuit 167–170 and create a low input to AND gate 171 which then activates AND gate 172, via inverter 173, and simultaneously deactivates circuit 152 AND gate 172 receives a higher frequency input from oscillator 174, having feedback means 175. The higher frequency is then applied to oscillator input line 153 in place of the output developed by oscillator 150. This will cause watch circuit 110 to run at an accelerated pace until OR gates 155–159 show a comparison at each bit position. The outputs of AND gates 163–166 then resume their rest states to cause reset circuits 176–179 (comprised of AND gates **176*a*–179*a* and inverters 176*b*–179*b*) to reset latches 167–170 when a corresponding digit drive (in this example) signal is also inputted thereto. The circuitry of reset circuit 176** is exemplary of one possible construction of such a reset circuit.

AND gate 171 also have one input derived from a "sufficient signal strength" output indication originating from receiver (161) via lead 180 and manual disconnect switch 181, which enables the user to disconnect the automatic time resetting function. This input indicates a signal of sufficient strength, and an appropriate code capable of being reliably decoded, has been received. This circuit is reset when the watch circuit output time code is identical with that of the master clock circuit $A_1$.

DIRECTLY PRESENTABLE COUNTER TECHNIQUE

In FIG. 6, transmitted coded time signals from circuits $A_1$, $B_1$ and $C_1$ are received by receiver 182, which may respond to transmission by way of a radio-frequency carrier, ultrasonic, infrared or other means. After processing, receiver 182 feeds demodulated coded time signals to decoder means 183. Decoded time signals are then applied to presettable counter circuit 184 which may be one of a plurality of counters represented by **184*a*, 184*b*, etc. and when an appropriately strong signal is received by receiver 182 and successfully decoded by decoder 183 a preset indication is conveyed via line 185*a* of circuit 185 to counter 184**, which then adopts this time signal and proceeds to count from that time indication and obliterates its own previous count.

The count, which may be in the binary coded decimal format may further be applied to decoder circuit 186 for subsequent application to display means 187 which may be an LED, LCD, or other means to provide a visual indication of the present count of counter 184.

TIME CORRECTION TRANSMITTER FOR STATIONARY USE

Figure 7:
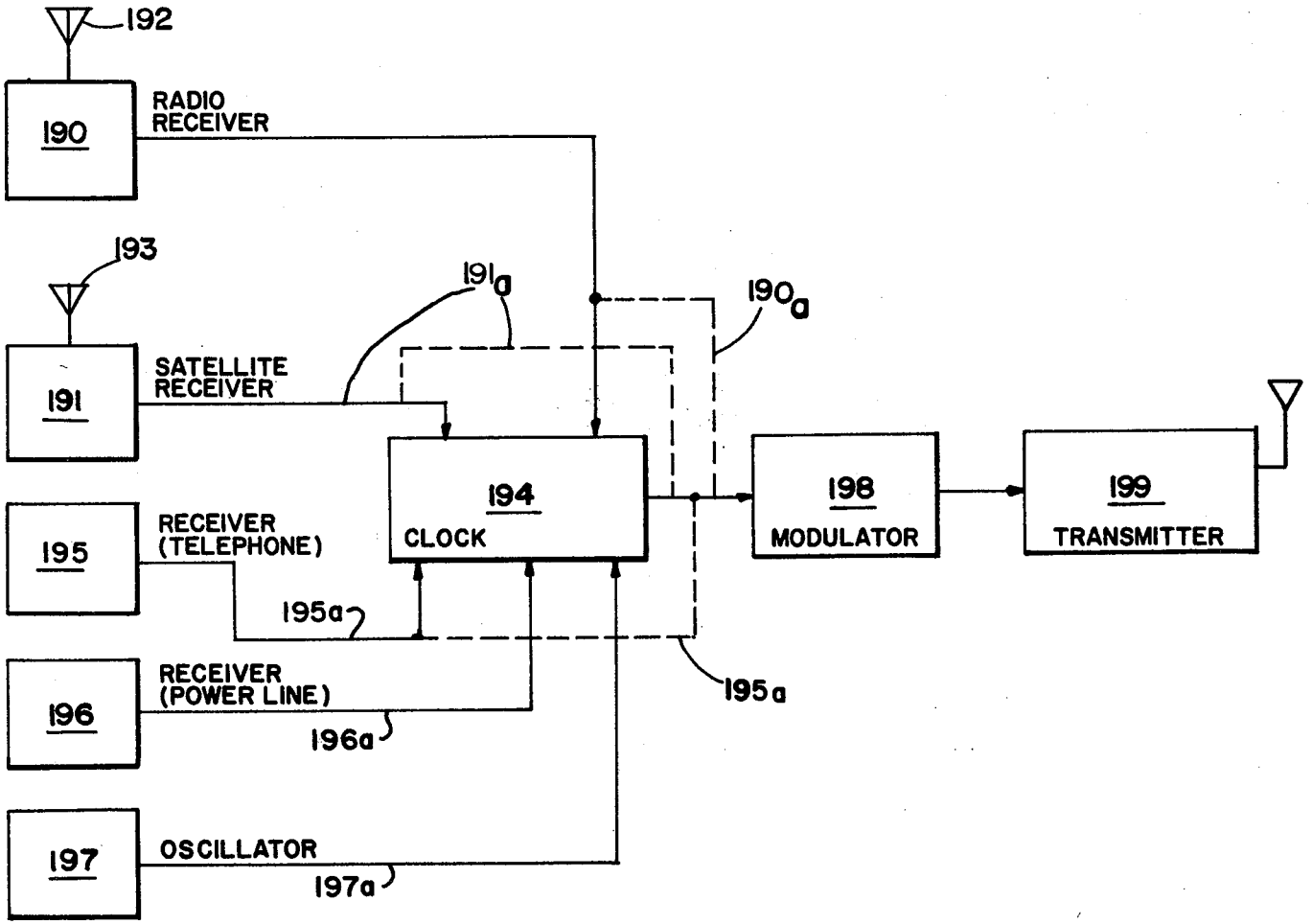

FIG. 7 is a representative of a time correction device which may be employed at a stationary location, such as: within a signpost along a road, or at the entrance to or exit from an airport, bus terminal, boat dock, etc. for the automatic resetting of timepieces, such as watches which are appropriately equipped with responsive circuitry. It is intended to deliver to a transmitting means, such as a radio transmitter, infrared emitter, ultrasonic transducer, or other convenient means, a coded time signal representative of the accurate local time, which may be derived from internal or external timing sources.

An accurate time signal may be received by a standard time broadcast radio receiver 190, or a satellite radio receiver 191, whose respective antennae are represented at 192 and 193. This received signal may be an actual coded time signal, or it may be an accurate standard frequency from which the time may be derived in an internal clock circuit 194 referenced to that standard frequency. In either case the time may be in universal time, local time or any other time zone notation.

Alternatively, the signals mentioned above may be derived from a telephone 195 (or other hard wired means from a remote location), the local power lines 196, whose frequency over a long period of time is generally very stable, or an integral oscillator 197 of high stability and accuracy, such as a crystal oscillator.

A clock circuit has been included in circuit 194 for use in the case where no stable accurate frequency standard is available from one or more of the above mentioned sources, or any other similar sources.

In the case where the actual coded time signals are readily available, such as from sources 190, 191 or 195, the clock circuit 194 is not necessary, unless a standard frequency is concurrently in use, and may be omitted with the coded time signals now being introduced directly to modulator circuit 198 via connection means **191*a*, 190*a*, 195*a*, and 196*a* and 197*a*** respectively.

Modulator circuit 198 may have as an input either coded time signals derived externally, as mentioned above, or coded time signals from the internal clock included in circuit 194. Its purpose is to further process the time signals and condition them for subsequent application to transmitting means 199, which may be any of several convenient means of transmission such as: a radio transmitter, an infrared generator, an ultrasonic transducer, a modulated light source, etc.

AUTOMATIC TIME CORRECTION FOR MOBILE OPERATION

Figure 8:
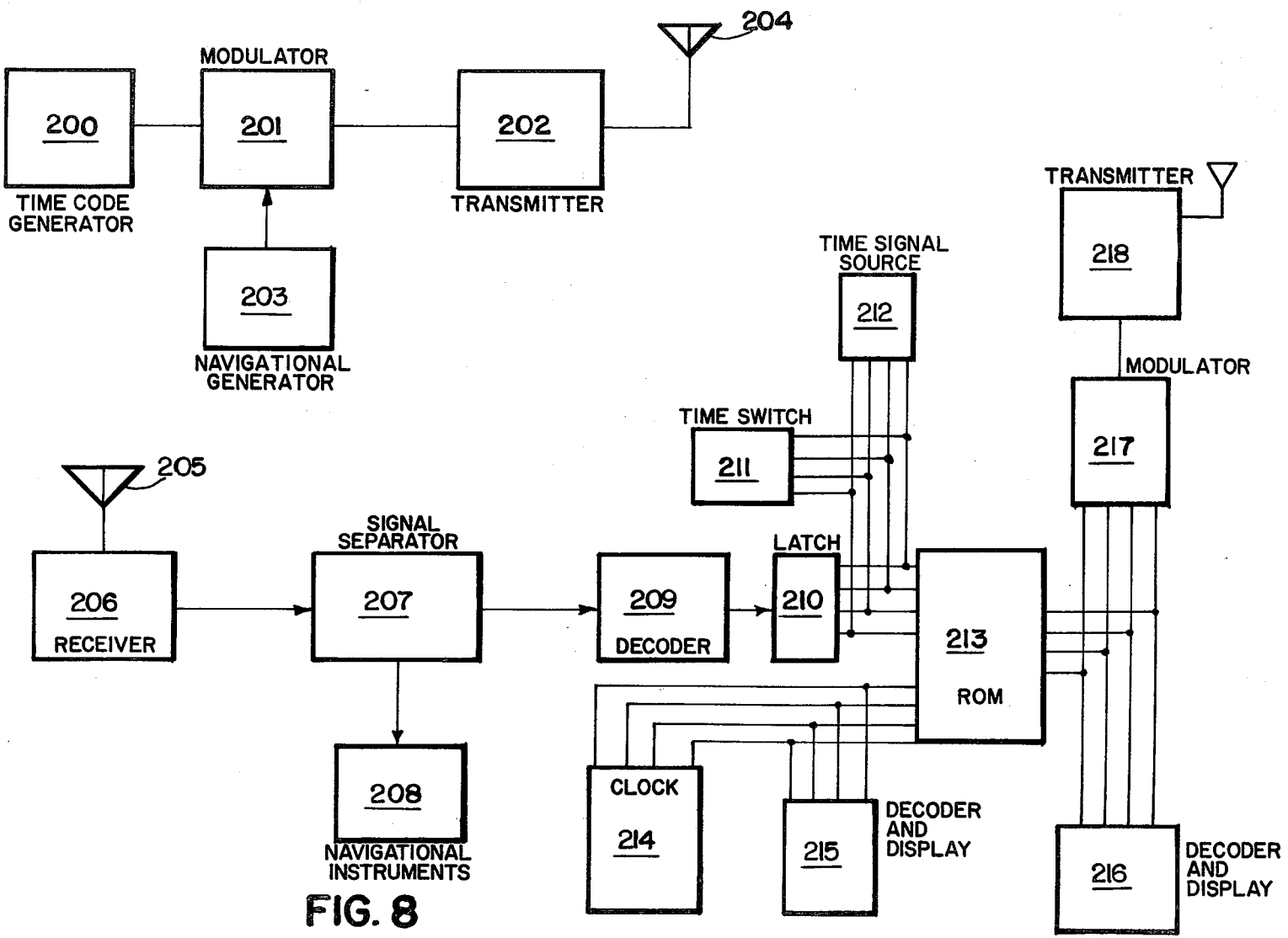

FIG. 8 is intended to represent a possible structure for a time correction means which may be incorporated in a moving vehicle in which there may be passengers, instrumentation or cargo equipped with timepieces which are capable of being automatically calibrated, by an external source, for actual time and/or time zone, date, etc., such as a bus, boat or aircraft. An application to an aircraft will be covered in the greatest depth in the following description as one such exemplary system.

A standard time code generator 200, which may be similar in construction to that in FIG. 7, and a navigational signal generator 203, present their respective information to modulator circuit 201 which applies their coded signals to transmitter 202 for application to antenna 204 for broadcasting to any aircraft within its range. Circuits 201–204 may be pre-existing equipment or may be newly installed and adapted to the additional function of time signal broadcasting. Also, circuits 202 and 203 need not necessarily be a navigational beam transmitter, but may be any conventional means available for transmission, such as: loran transmitters for boats; one or two-way voice or other code information channels, which may be more convenient to use for this purpose, or radio, television or satellite stations, for the direct transmission of these time signals, or any other suitable means.

On board the vehicle, signals received by antenna 205 are processed by receiver circuit 206 and applied to signal separator 207. Separator 207 removes the navigational (or other) signals, received by antenna 205 and receiver 206 from the time signals which are of primary interest in the present system. Navigational (or other) signals from 207 are applied to their instruments in a conventional manner at 208.

The time signals from 207 are applied to decoder circuit 209 which may take the time signals directly and conditions them for subsequent application to the remainder of the circuit, or it may respond, in this case, to the unique code broadcast with a navigational or other signal. In the latter case, 208 is preferably provided with a memory of all the unique codes and their plus or minus quantitative hour relationship to a single time zone such as that for Universal Time, or any other. For each time zone as determined by the pre-existing navigational code, circuit 209 would drive an individual code indicative of the number of hours to be added to or subtracted from the standard time (U.T., GMT, etc.). In the event that the system mentioned immediately above is employed, it would be unnecessary to modify the pre-existing navigational equipment, except for connection to its output. This would be desirable for application to aircraft navigational receivers.

Latch circuit 210 accepts the coded signals, which may only be present for a short period of time, and applies them to read-only memory (ROM) 213 as a partial set of inputs. Alternatively, manually operated coded time switch 211 may be entered into ROM 213 in lieu of, or in combination with the contents of latch circuits 210, or any other time signal source, represented by circuit 212, which may be an accurate tape recording with time zones stored therein, as well as flight path information from some other source, a navigational satellite, directly or indirectly, etc.

The remainder of the inputs to ROM 213 which may alternatively be an adder circuit to combine the hour correction with the standard time signal, is from an adjacent clock circuit 214 which keeps track of time in the chosen zone as mentioned previously (U.T., GMT or other). This time code may be converted to provide a visual display of the time by decoder and visual display means 215.

The output of circuit 213 is a coded version of the present time in the chosen time zone corrected for the present location of the timepiece, and is presented to modulator means 217 which conditions it for subsequent application to transmitting means 218, which may be an infrared transmitter, radio waves, ultrasonic or any other convenient means. This transmission will be short range and is intended for the automatic resetting of timekeeping devices, for example specially adapted watches which may be carried by passengers in the vehicle.

The present time may also be displayed by decoder and display means 216 for a visual check of the time setting, or simply to display the time as a courtesy to passengers.

As an additional alternative it should be noted that it may not be necessary to actually transmit the resetting signals via 217 and 218, but it may be desirable to directly, or indirectly, connect the correction signals to the timekeeping device at the users discretion.

FIG. 9 shows a circuit arrangement which provides a timepiece with an alarm capability. An alarm code generator 225, energized by power source 226, generates a coded signal which is applied to transmitter 227 adapted for a small localized transmission range.

The timepiece contains a watch receiver 228 which receives and decodes the coded alarm signal and applies it to code responsive relay device 229. When the coded signal unique to the relay device is received, alarm 230 is enabled to provide an audible and/or visually observable alarm.

Switch 233, manually operable from the exterior of the timepiece, may be opened to disconnect the alarm from power source 231 to disable the alarm function. As an alternative, switch 232, similar in both design and function to switch 233, may be provided to deactivate the alarm function by deactivating the receiver and relay circuits.

The timepiece contains a receiver 228 which receives and decodes the coded alarm signal and applies the decoded signal to code responsive relay device 229. When the coded signal unique to the relay device is received, alarm 230 is enabled to provide an audible and/or visually observable alarm.

Switch 233, manually operable from the exterior of the timepiece, may be opened to disconnect the alarm from power source 231 to disable the alarm function. As an alternative, switch 232, similar in both design and function to switch 233, may be provided to deactivate the alarm function by deactivating the receiver and relay circuits.

In operation, each room of a hotel may be provided with an antenna having a very short transmitting range. In response to the wake-up request of a hotel guest, the antenna in the guest's room is coupled to receive the coded alarm signal. The watch receiver, when energized, picks up and decodes the coded signal and applies it to relay device 229. In one highly simplified embodiment, the signal, which may be of a discrete frequency, is passed through a narrow band-pass filter **229*a* (FIG. 9*a*) to set a bistable flip-flop 229*b* in the presence of the coded signal. The flip-flop output applies an enabling signal to the alarm switch (transistor Q1). Opening switch 223 (or 233) deactivates transistor Q1, and hence the alarm. A delay circuit 229*c*** may be provided to limit the time that the alarm remains energized, by resetting the flip-flop when the delay circuit times out.

Switch 233 (or 232) is preferably provided with a momentary contact connection **232*a* with the reset input of the flip-flop to reset the flip-flop at the same time that the alarm 230** is deenergized.

The alarm may also be activated during a time-setting operation or may be employed to indicate the need for a time-setting operation.

In operation, each room of a hotel may be provided with an antenna having a very short transmitting range. In response to the wake-up request of a hotel guest, the antenna in the guest's room is coupled to receive the coded alarm signal. The watch receive when energized, picks up and decodes the coded signal and applies it to relay device 229. In one highly simplified embodiment, the signal, which may be of a discrete frequency, is passed through a narrow band-pass filter **229*a* (FIG. 9*a*) to set a bistable flip-flop 229*b* in the presence of the coded signal. The flip-flop output applies an enabling signal to the alarm switch (transistor Q1). Opening switch 232 (or 233) deactivates Q1, and hence the alarm. A delay circuit 229*c*** may be provided to limit the time that the alarm remains energized, by resetting the flip-flop when the delay circuit times out.

Switch 233 (or 232) is preferably provided with a momentary contact connection **232*a* with the reset input of the flip-flop to reset the flip-flop at the same time that the alarm 230** is deenergized.

The alarm may also be activated during a time-setting operation or may be employed to indicate the need for a time-setting operation.

As another alternative arrangement, and considering FIG. 2, one output of the counter 65 is coupled to one input of gate G1, which is enabled to couple a pulse of higher frequency to the hours counter unit 70 through OR gate G2. As is well known, the oscillator circuut has a relatively high operating frequency which is divided down by counter 65 to provide a one pulse per second signal rate at output 65*a*. The oscillator may have an operating frequency of 32,768 Hz. A signal of much higher frequency than one pulse per second may be derived from an intermediate stage of counter 65 to perform the time setting operation at a rapid rate without the need for providing a separate oscillator source.

As another alternative arrangement, and considering FIG. 2, one output of the counter 65 is coupled to one input of gate G1, which is enabled to couple a pulse of higher frequency to the hours counter unit 70 through OR gate G2. As is well known, the oscillator circuit has a relatively high operating frequency which is divided down by counter 65 to provide a one pulse per second signal rate at output 65*a*. The oscillator may have an operating frequency of 32,768 Hz. A signal of much higher frequency than one pulse per second may be derived from an intermediate stage of counter 65 to perform the time setting operation at a rapid rate without the need for providing a separate oscillator source.

Alternative forms of the contemplated are within the above teachings as follows:

I. An alarm such as a solid state or otherwise operated electrical-to-sound transducer may be employed in one or more of the housings for the personal timepieces which are subject to time correction as described and may be utilized for a number of purposes including indicating when a preset time exists in the time keeping circuitry of the watch. The alarm may also become activated and generate a sound in response to the receipt of an externally generated code signal or radiation received by the receiver of the timepiece or watch either when such code signal is generated or when the watch is brought within range of the radiation so generated as to activate a sensor for sensing such radiation and located within the same housing as the timepiece. For example, a short wave generator of a specific tone or code may be disposed in the vicinity of a hazardous condition in cases where it is desired to warn persons. The code or tone may be generated continuously or intermittently and when so generated, if a person wearing or holding such time pieces has such an alarm and code or tone sensor in its circuit, the warning signal operates to activate said sensor and alarm. The alarm may also be employed to indicate to the holder of the watch to take a certain action upon activation thereof by a local or remotely generated code signal.

II. The timepiece housing may also contain a plurality of different alarms, such as electrical-to-sound generators which generate sounds of different pitch or tone or a single generator which generates a different number of intermittent sounds in response to the activation of different tone or code relays connected to the output of the short wave receiver for the timepiece. Thus the owner or wearer of the timepiece may receive and discriminate between different warnings or indications as defined by the different tones or code signals received by the receiver.

III. The timepiece subsystem which enables the holder of the timepiece to receive an audible indication of an environmental condition, may also be used to locally indicate by audible or feel sensory means the time of day in response to locally generated tone or code signals generated by the described clock transmitting means. For example, the sound transducer may be activated to generate the number of beeps or tones, the number of which is an indication of the local time. Such indication may also be effected by the timekeeping and display driving circuits of the watch intermittently energizing the sound transducer.

IV. The code signal generator which generates short wave codes for activating the sound transducers of the watches adapted to be so activated, may be timer controlled or computer controlled or controlled in response to movement of a person or object into a sensed field or to otherwise activate a switch or sensor, so as to generate such short wave signal or signals to effect operation of selected alarms or all alarms in a given range thereof.

V. Satellite communication means such as earth satellites or earthbound relay stations may be employed to transmit the described codes to the alarm activating sensors.

It should be understood with respect to all of the embodiments described above that power supplies having the correct polarities and magnitudes are provided where not indicated in the drawings, to supply proper electrical energy for appropriately operating the various illustrated components and circuits as described in the specification.

What is claimed is:

1. A time keeping system comprising in combination:

a master signal generator operable for intermittently generating signals representative of time in a given time zone, means for effecting the wireless transmission of said time signals throughout a given spatial region;

at least one electronic timepiece containing electronic circuit means for generating signals at a first rate representative of time and display means for displaying the time represented by the signal generated, signal receiving means for receiving the signals generated by said master signal generating means, said electronic circuit means including further circuit means connected to receive the signals from said signal receiving means and operable to alter the signal output rate of the electronic circuit means of said timepiece in accordance with variations between the values of the signals generated by the timepiece and those received from said master signal generating means whereby the signals fed to said display means for displaying the time will be representative of the time as defined by the signals generated by said master signal generating means.

2. A system in accordance with claim 1 wherein said means for transmitting the signals generated by said master signal generating means comprises short wave radio transmitting means.

3. A system in accordance with claim 1 wherein said means for transmitting said signals generated by said master signal generating means comprises ultrasonic signal generating means and said receiving means of said timepiece comprises means responsive to the ultrasonic signals generated for generating electrical signals on the output thereof in accordance with the ultrasonic signals received from said master signal generating means.

4. A system in accordance with claim 1 wherein said timepiece contains a battery providing the power for operating the time piece and a circuit including a switch and means for connecting the battery to said signal receiving means only when the switch is closed.

5. A system in accordance with claim 4 wherein said switch is normally open and manually closeable to normally reduce the drain on said battery while the switch is open and to permit the selective operation of the switch when it is desired to change the timepiece display.

6. A system in accordance with claim 1 including an alarm supported by said timepiece, control means for selectively operating said alarm and means for generating and transmitting a second wireless signal to said timepiece to which said alarm control means is responsive for activating said alarm when said signal is received thereby.

7. A system in accordance with claim 6 wherein said alarm includes transducer means for generating an audible alarm at least a portion of said time when said alarm is activated.

8. A system in accordance with claim 7 wherein delay means is provided for automatically terminating operation of the alarm means a predetermined time after initiation of the alarm signal.

9. The apparatus of claim 7 wherein said alarm means also includes a visually observable alarm means.

10. The apparatus of claim 1 wherein said electronic timepiece further includes first and second control circuits for driving said time display means responsive to said electronic circuit means, one said control circuit being selectively connectable to drive said display means while the other one of said control circuits is coupled to be corrected by means of said code signals and is selectively connectable to said display driving circuits.

11. The apparatus of claim 10 wherein the timepiece further includes manual means for connecting one of said control circuits with the said display means and for connecting the other one of said control circuits to receive said code signals.

12. A time keeping and control system comprising in combination:

an electronic timepiece including visually observable display means, automatic time computing means having a normal operating rate and driving means connected to said computing means and controlled thereby for controlling said display means to display the time defined by the output of said automatic time computing means, a source of electrical energy for energizing said automatic time computing means, said driving means and said display means, the improvement comprising:

a time code signal generator remote and separate from said timepiece including means for generating and transmitting remote code signal which are indicative of the correct time in a given time zone, receiver means responsive to said code signals for causing said automatic time computing means to operate at a rate greater than its normal operating rate whereby the output thereof applied to said driving means will cause said driving means to rapidly step said display means, said receiver means further comprising means responsive to said remote code signals from said time code signal generator to generate electrical signals which are representative of the remote code signals generated by said code generator, means coupled to said automatic time computing means for generating local code signals indicative of the time display by said display means, means for comparing said remote code signals with said local code signals received and for generating a control signal when the remote and local code signals match, means responsive to said control signal for terminating the operation of said automatic timing computing means at said rapid rate whereby the time defined by said automatic time computing means coincides with that defined by the output of said code signal generator and said display means is operated to display the correct time of said time zone.

13. A system in accordance with claim 12 wherein said code signal generator and transmitter and said receiver are short wave devices.

14. A system in accordance with claim 12 wherein said signal transmitter includes means for generating ultrasonic signals and said receiver includes means for converting said ultrasonic signals to electrical signals.

15. A system in accordance with claim 12 wherein said time code signal generator is operable to generate code signals indicative of the hour of the day and means for automatically changing the code signals generated with each changing hour so as to cause the signals generated to be indicative of each hour in which the code signal is generated.

16. A system in accordance with claim 15 whereby, in order to adapt said time code signal generating and transmitting means for use in vehicles capable of traveling through various global time zones, means are provided for controlling the operation of said time code signal generator to change the code signal generated thereby when said time code transmitter means enters into a time zone to cause said generator to generate a code signal indicative of the time of the zone through which it is traveling when the code signal is generated thereby.

17. A system in accordance with claim 16 wherein said means for varying the operation of said time code signal generator is manually controlled.

18. A system in accordance with claim 16 wherein the means for varying the operation of said time code signal generator is automatically controlled.

19. A system in accordance with claim 16 wherein the means for varying the operation of said time code signal generator includes means for detecting when said time code transmitter enters a new global time zone to generate a control signal, means for receiving said control signal, means connected to said receiving means which is responsive to said control signal for controlling the operation of said signal generator to cause said signal generator to generate the correct time code signal for the time zone in which said signal generator is presently located.

20. A system in accordance with claim 19 wherein said detecting means includes a short wave receiver for receiving signals from a transmitter located within at least one time zone which transmitter generates and transmits short wave signals to said short wave receiver, said short wave receiver being operable to receive said short wave signals upon entering said time zone.

21. A system in accordance with claim 16 including means for changing the operation of said code signal generating means each time said time code transmitter enters into a new time zone whereby the signals generated thereby will operate to properly correct said timepiece in accordance with the time in said new zone.

22. A system in accordance with claim 15 which includes different fixedly located code signal generators for generating proper time indicating signals in different fixed publically traveled locations of different time zones for properly correcting the time displayed by said timepiece.

23. A system in accordance with claim 12 wherein said timepiece includes manually operable means for enabling said timepiece to be properly corrected by the signal generated in each time zone.

24. A method of automatically resetting or correcting the display driving circuitry of an electronic timepiece having a time computing circuit and driving circuit to permit the character displays thereof to display the correct time comprising:

generating wireless code signals which are indicative of the correct time in a given time zone and changing said code signals with equal increments in time to indicate the proper time within said time zone, receiving said code signals in a time correcting circuit connected to the time computing and driving circuitry of an electronic timepiece, causing at least a portion of said time computing and driving circuitry of said timepiece to incrementally step in time at a rate substantially higher than the normal stepping rate for said timepiece, generating code signals with the increases in time indicated by the rapid stepping of said computing and driving circuitry, comparing said latter generated code signals with the received code signals, and terminating said incremental stepping of said computing and driving circuitry at said higher rate when the code signals compare with each other whereby the time which is indicated thereafter by said displays of said timepiece is the correct time as defined in the time zone by said generated wireless code signals.

25. A method in accordance with claim 24 wherein said correct time indicating code signals are generated and transmitted to said receiving means by creating ultrasonic wave energy and modulating said ultrasonic wave energy in accordance with said code signals.

* * * * *